US006192864B1

(12) United States Patent
Nishimura

(10) Patent No.: US 6,192,864 B1
(45) Date of Patent: Feb. 27, 2001

(54) COMMON-RAIL FUEL-INJECTION SYSTEM

(75) Inventor: Terukazu Nishimura, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/594,573

(22) Filed: Jun. 15, 2000

(30) Foreign Application Priority Data

Jun. 15, 1999 (JP) ..... 11-168395

(51) Int. Cl.[7] ..... F02M 37/04
(52) U.S. Cl. ..... 123/458; 123/456
(58) Field of Search ..... 123/456, 457, 123/458, 510, 511, 446, 497, 357

(56) References Cited

U.S. PATENT DOCUMENTS 5,058,553 * 10/1991 Kondo et al. ..... 123/458
5,313,924 * 5/1994 Regueiro ..... 123/458
5,720,262 * 2/1998 Antonioli et al. ..... 123/458
6,024,072 * 2/2000 Hamada ..... 123/456
6,055,961 * 5/2000 Friedrich ..... 123/458
6,085,727 * 7/2000 Nakano ..... 123/456
6,102,009 * 8/2000 Nishiyama ..... 123/456
6,119,655 * 9/2000 Heinitz et al. ..... 123/458

FOREIGN PATENT DOCUMENTS 11050926 2/1999 (JP) .
11082104 3/1999 (JP) .

* cited by examiner

*Primary Examiner*—Thomas N. Moulis
(74) *Attorney, Agent, or Firm*—Browdy and Neimark

(57) ABSTRACT

Disclosed is a common-rail fuel injection system which regulates an amount of fuel delivered at every plunger in a high-pressure fuel-supply pump, thereby enabling to control an actual common-rail pressure restored at every fuel delivery forced by the plunger so as to come in matching a desired common-rail pressure. A fundamental desired amount of fuel delivered is found dependent on the desired common-rail pressure derived from the engine operating conditions. A correction amount of fuel delivered is calculated at every plunger on the basis of a deviation in the common-rail pressure, which is derived from the actual common-rail pressure restored with the fuel delivery and sensed at every fuel delivery. Each plunger delivers under pressure an ultimate amount of fuel that is compensated with the correction amount of fuel delivered, thereby making the common-rail pressure coincide with the desired common-rail pressure.

5 Claims, 6 Drawing Sheets

COMMON-RAIL FUEL-INJECTION SYSTEM

BACKGROUND OF THE INVENTION

1. Field of the Invention

The present invention relates to a common-rail fuel-injection system for an internal combustion engine in which fuel forced from a high-pressure fuel-supply plunger pump is maintained at a constant pressure in a common rail, and is injected out of injectors connected with the common rail.

2. Description of the Prior Art

Common-rail fuel-injection systems have been conventionally known as the most suitable way to increase injection pressures and also control injection factors such as injection timing, amount of fuel injected per cycle and the like, depending on engine operating conditions. Among the prior common-rail fuel-injection systems there is a fuel-injection system in which working fluid pumped up to a preselected pressure is stored for fuel injection to actuate injectors, each of which is arranged in individual cylinders, thereby injecting a metered amount of fuel out of the injectors into their associated combustion chambers. A control unit controls valves installed in the individual injectors to inject fuel with the fuel-injection factors optimal to the engine operating conditions.

In contrast, the common-rail fuel-injection system of fuel-pressure actuated type has been known in which fuel serves as the working fluid. Governing for this type of fuel injection is effected by fuel pressures corresponding to the injection pressures, which are continually maintained in fuel passages from the common rail through injection lines to injection orifices formed at the distal ends of the injectors, each of which has a control valve allowing to flow or blocking the fuel supplied through the injection lines, and a solenoid-operated actuator to drive the control valve. A control unit regulates the fuel pressures in the common rail and the operation of the solenoid-operated actuators in the injectors to inject the pressurized fuel out of the individual injectors in accordance with the injection factors most suitable for the engine operating conditions. Moreover, a further another type of the common-rail fuel-injection system has been proposed, in which the working fluid is provided by engine oil stored under pressure in the common rail. The engine oil applied to pressure chambers in the injectors from the common rail provides hydraulic pressures to boost the fuel in pressure to a desired pressure, which is supplied into intensifying chambers in the injectors.

Referring to FIG. 7, the prior common-rail fuel-injection system of fuel-pressure actuated type will be explained in detail hereinafter.

Fuel drawn in by a fuel-feed pump 6 from a fuel tank 7 is applied to a high-pressure fuel-supply pump 1, which is a variable-delivery high-pressure plunger pump to force the fuel into a common rail 2. The fuel stored under pressure in the common rail 2 is allowed to pass through injection lines 23 included in a fuel passage system to injectors 3, each of which is installed in each cylinder, in accordance with the type of engine. The fuel finally is injected out of the individual injectors into their associated combustion chambers. The high-pressure fuel-supply plunger pump 1, besides the type illustrated, may be any one of rotary-plunger pump and inline-plunger pump in accordance with the type of engine.

The high-pressure fuel-supply plunger pump 1 has a cam 10 driven by the engine output to operate the pump, and a plunger 11 riding on the cam 10 to move in and out, with the plunger 11 forming at its top surface a part of the inside barrel wall defining a pumping chamber 12. An inlet valve 15 is arranged between the pumping chamber 12 and a fuel inlet line 13, and acts to regulate an amount of fuel forced into the pumping chamber 12 from the fuel-feed pump 6 through the fuel inlet line 13. A non-return valve 17 is interposed along a fuel discharge line 14 connecting the pumping chamber 12 with the common rail 2, and may open when the pressure created by the high-pressure fuel-supply plunger pump 1 is become over a preselected delivery pressure.

In order to keep the common-rail pressure from unexpected rise due to, for example, abnormality in control system, there is a relief valve 20, normally closed, which may open when subjected to a higher pressure than a preselected pressure, permitting the fuel held in the common rail 2 to escape to the fuel tank 7 through a relief line 21 with the result of reducing the common-rail pressure. Moreover, a pressure sensor 22 monitors the common-rail pressure Pr, which is in turn signaled to a control unit 8 of electronic controlled module, which is commonly contracted to EMC.

The injectors 3 are hermetically fitted with sealing members in holes bored in a base member such as a cylinder head. The injectors 3 each comprise a needle valve 31 movable up and down in a injector body, injection orifices 32 formed at an distal end of an injection nozzle to open when the needle valve 31 lifts off its seat, thereby injecting the fuel into a combustion chamber, not shown. The needle valve 31 has a top surface 33 that provides a part of a balance chamber 30, which is applied with the high-pressure fuel from the associated injection line 23. A fuel passage 34 connected with the injection line 23 is opened to a fuel sac 35 formed around the needle valve 31. Thus, the needle valve 31 exposed to the fuel sac 35 is subject to the fuel pressure at its first tapered surface 36, thus encountering the hydraulic force to lift the needle valve 31. On the other hand, the needle valve 31 encounters both of the downward thrust due to the fuel pressure in the balance chamber 30 and the return force of a return spring 47. Thus, the balance among the upward and downward hydraulic forces and the return force may govern the lift of the needle valve 31. On the closure of the needle valve 31, a second tapered surface 37 nearby the distal end of the needle valve 31 comes in engagement with a tapered valve seat to block the fuel passage between the injection orifices 32 and the fuel sac 35 around the needle valve 31.

While the high-pressure fuel in the common rail 2 is supplied to the balance chamber 30 through a fuel supply line 38 branching off from the injection line 23, the fuel in the balance chamber 30 is expelled through a drain line 40. The fuel supply line 38 and drain line 40 are provided respectively with throats 39, 41, that are defined such that the throat 41 is larger in effective cross-section area than another throat 39. Moreover, the drain line 40 is provided therein with a valve 44, which is to relieve the fuel in the drain line 40 to a fuel return line 46.

Control current from the control unit 8 energizes a solenoid 45 to open the valve 44 in the drain line 40. Thus, since the fuel flow at the throat 39 is more restricted than at the throat 41, the fuel pressure in the balance chamber 30 drops so that the force to lift the needle valve 31 off the seat overcomes the sum of the depressing force resulting from the fuel pressure in the balance chamber 30 and the resilient force of the return spring 47 to allow the needle valve 31 lifting off the seat with the fuel being injected out of the injection orifices 32 into the combustion chamber. The unconsumed fuel remaining the injector may be expelled out of the balance chamber 30 through the drain line 40 and recovered into the fuel tank 7 through the fuel return line 46.

The control unit 8 is applied with various signals of sensors 9 such as a crankshaft position sensor for detecting the engine rpm Ne, an accelerator pedal sensor for detecting the depression Ac of an accelerator pedal, and so on. The sensors 9 may also include other sensors for monitoring the engine operating conditions, for example, an engine coolant temperature sensor, a engine cylinder identifying sensor, a top dead center detection sensor, an atmospheric temperature sensor, an atmospheric pressure sensor, an intake manifold pressure sensor, and so on.

The control unit 8, on the basis of an injection characteristics map stored previously in memory, finds desired injection factors in accordance with the signals issued from the diverse sensors 9, and the valve 44 opens and closes, depending on the desired injection factors, to control the lift of the needle valve 31. The desired injection factors are defined to determine a injection timing and an amount of fuel injectes out of the injector 3 per cycle so as to make the engine output optimum for the engine operating conditions. The injection timing and the amount of fuel injected are dependent upon injection pressure as well as the lift, or amount and duration of lift, of the needle valve 31. The control unit 8 issues a command pulse to determine a driving current to energize the solenoid 45, which in turn opens and closes the valve 44 to regulate the lift of the needle valve 31.

Especially, the relation between the amount of fuel injected out of the injector 3 and the pulse width of the command pulse issued from the control unit 8 is plotted with the common rail pressure Pr, or fuel pressure in the common rail 2, as a parameter. The injection timing may be controlled by governing the time the command pulse is turned on/off, because the fuel injection starts or ceases with a preselected delay time after a time either the command pulse falls or rises. Relation between the fundamental amount of fuel injected and the engine rpm Ne is stored previously in a map of fundamental amount characteristics of fuel injected, in which they are plotted with the accelerator-pedal depression Ac as a parameter. Thus, the amount of fuel injected may be calculated on the basis of the map of fundamental amount characteristics of fuel injected, depending on the engine operating conditions. Although but only one injector 3 is shown in the illustrative example, the engine of this type is usually a multi-cylinder engine, for example, a four-cylinder engine or six-cylinder engine, and the control unit 8 controls individually the fuel injection for the injector 3 located in each cylinder.

As the injection pressure to inject the fuel out of the injector 3 is substantially equal the fuel pressure held in the common rail 2, the control of the common-rail pressure Pr results in controlling the injection pressure. Even if the engine operating conditions were held unvaried, the common-rail pressure Pr would drop due to fuel consumption in the common rail 2 at every fuel injection out of the injector 3. In contrast, when the engine operating conditions change, the common-rail pressure Pr should be altered to other common-rail pressure optimum for the changed operating conditions. To cope with this, the control unit 8 regulates amount delivered out of the high-pressure fuel-supply plunger pump 1 to keep the fuel pressure in the common to rail 2 at the preselected pressure or change continually it to the pressure required for the varied engine operating conditions.

For regulating the common-rail pressure Pr, a desired common-rail pressure is first found dependent on engine rpm Ne and the desired amount of fuel to be injected, which is determined in accordance with the engine operating conditions. Then, the amount of fuel delivered out of the high-pressure fuel-supply plunger pump 1, or the amount of fuel corresponding to the effective stroke of the plunger, is subjected to the feedback control to eliminate the deviation of actual common-rail pressure detected at the pressure sensor 22 from the desired common-rail pressure.

Among prior systems to regulate the amount of fuel delivered out of the high-pressure fuel-supply plunger pump 1 in the common-rail fuel-injection system shown in FIG. 7, there has been a system that is termed pre-stroke control, in which an inlet valve 15 is controlled according to the pre-stroke way. That is to say, the fuel admitted in the pumping chamber 12, although but allowed to return through the fuel inlet line 13 to the fuel tank 7 as long as a fuel inlet valve 15 in the fuel inlet line 13 is kept open, even during the lift stroke of the plunger 11, is forced towards the delivery side of the pump just after the inlet valve 15 has been closed whereby the amount of fuel delivered out of the high-pressure fuel-supply plunger pump 1 is regulated to result in controlling the common-rail pressure Pr. As there is provided a relief valve 18 to set an upper limit on the fuel pressure, or feed pressure, in the inlet line 13, excess fuel fed from the fuel-feed pump 6 is left returned through the relief valve 18 and return fuel return line 19 to the fuel tank 7.

Incidentally, the high-pressure fuel-supply pump is usually of the type having plural plungers regardless of either inline arrangement or rotary arrangement. In the prior common-rail fuel-injection systems, moreover, the actual common-rail pressure adopted to control the common-rail pressure is the value found to have on the average the common-rail pressures sensed at every fuel delivery of the individual plungers or at every fuel injection of the individual injectors. On the other hand, the amounts of fuel delivered at the individual plunger strokes and/or injected out of the individual injectors are hardly avoidable variations caused by the scattering in mechanical characteristics and aging of the individuals. Thus, as long as the amount of fuel to be delivered out of the high-pressure fuel-supply plunger pump is metered depending on the actual common-rail pressure represented by the average value as described just above, the feedback control seeking to keep the actual common-rail pressure the desired common-rail pressure results in causing the variations at every cylinder in either of the pressure rise in the common-rail pressure owing to the fuel delivery from the high-pressure fuel-supply plunger pump and the pressure drop in the common-rail pressure resulting from the fuel injection out of the injectors. This causes the scattering in fuel-injection pressure. In the common-rail fuel-injection system, it would be substantially impossible to make the fuel injected out at every injector the same amount so long as the variations in common-rail pressure are eliminated, even if the injectors were made uniform in their injection characteristics. On low-speed operation of engines such as idling, especially, scattering in injection at every cylinder raises the variations in combustion condition, which result in the occurrence of uncomfortable vibration or noise. In addition, even if the high-pressure fuel-supply plunger pump is of the type having a single plunger driven with a multi-lobe cam, there is the problem, as in the multi-plunger type described above, in which the amount of fuel delivered might vary at every cam-operation of the lobes.

Considering that the desired value of common-rail pressure to be determined dependent on the engine operating conditions should be the common-rail pressure at any timing of restoration in pressure, which is after the fuel has been delivered out of the high-pressure fuel-supply plunger pump into the common rail to recover the common-rail pressure but before the fuel injection at the individual injector is initiated to cause the pressure drop in the common rail, it will be expected to make the common-rail pressure restore uniformly to the desired value with the fuel discharge from the high-pressure fuel-supply plunger pump just after the fuel injection of the individual injector, regardless of whether or not there exists any scattering in the amount of fuel delivered out of the individual plunger pump.

SUMMARY OF THE INVENTION

The present invention, therefore, has as its principal object the provision of a common-rail fuel-injection system for an internal combustion engine that is so constructed as to allow uniform restoration of the common-rail pressure, which has dropped due to fuel injection out of the individual injectors, to the desired pressure value with the fuel delivered out of the high-pressure fuel-supply plunger pump, regardless of whether or not there exists any scattering in the amount of fuel delivered out of the individual plunger pump. Especially, the present invention is desirable to provide a common-rail fuel-injection system in which no scattering in fuel injection at every cylinder results in the elimination of variation in the amount of fuel injected, thus preventing the occurrence of uncomfortable vibration and noise, even under the low-speed operation of the engines such as idling.

The present invention is concerned with a common-rail fuel-injection system for an internal combustion engine, comprising a fuel supply pump to deliver fuel with pumping action of a plunger, a common rail to store therein the fuel delivered out of the fuel supply pump under pressure, injectors each of which is arranged in each cylinder of the engine, to inject the fuel in the common rail into the cylinders, sensor means to monitor engine operating conditions, a pressure sensor to monitor a pressure in the common rail, and a control unit to find injection factors, including a desired common-rail pressure, of fuel to be injected out of the injectors, depending on signals reported from the sensor means, and further control a fuel delivery forced by the plunger in the fuel supply pump and a fuel injection out of the injector in accordance with the injection factors; wherein the pressure sensor detects an actual common-rail pressure at the time between pressure restoration with the fuel delivered by the plunger and pressure drop due to fuel injection out of the injector, and the control unit compensates an amount of fuel to be delivered into the common rail, depending on a deviation of the actual common-rail pressure from the desired common-rail pressure, at every fuel delivery forced by the plunger, so that the actual common-rail pressure coincides with the desired common-rail pressure.

Fuel discharged out of the fuel supply pump is held under pressure in the common rail. The fuel fed from the common rail is injected out of the injectors into the combustion chambers of the individual cylinders. The control unit finds the injection factors for fuel to be injected out of the injector, depending on the engine operating conditions reported from the diverse sensor means, and then adjusts the fuel pressure in the common rail, which is maintained with the fuel delivered from the fuel supply pump, and the fuel injection out of the injectors in accordance with the injection factors. In the fuel-injection system of the present invention, the actual common-rail pressure is determined at the timing after the common-rail pressure has been restored with the fuel delivered under pressure out of the fuel supply pump but before the pressure drop due to fuel injection out of the injectors. Thus, the deviation of the actual common-rail pressure from the desired common-rail pressure may be found at every fuel delivery. As the control unit compensates an amount of fuel to be delivered under pressure into the common rail, depending on the deviation about the common-rail pressure at every fuel delivery, the feedback control will be effectively accomplished to make the actual common-rail pressure restored with the fuel delivery coincide with the desired common-rail pressure, despite of whether or not there exists any scattering in the amount of fuel delivered per individual plunger stroke.

In an aspect of the present invention, a common-rail fuel-injection system is disclosed, wherein the control unit finds a fundamental desired amount of fuel to be delivered by the plunger in accordance with the desired common-rail pressure, compensates the fundamental desired amount of fuel to be delivered with a correction amount of fuel, which is calculated dependent on the deviation of the actual common-rail pressure, thereby finding an ultimate desired amount of fuel delivered at every fuel delivery forced by the plunger, and regulates a fuel delivery duration to be delivered by the plunger in accordance with the ultimate desired amount of fuel to make the actual common-rail pressure coincide with the desired common-rail pressure. If no actual common-rail pressure came in coincidence with the desired common-rail pressure, the correction amount of fuel delivered would be found to compensate the fundamental desired amount of fuel delivered, depending on the deviation about the common-rail pressure. Then, the ultimate fundamental desired amount of fuel to be delivered is given by compensating the fundamental desired amount of fuel delivered with the correction amount of fuel delivered. The fuel delivery duration at every fuel delivery is adjusted to make the amount of fuel delivered out of the fuel supply pump the ultimate desired amount of fuel to be delivered, which has been compensated.

In another aspect of the present invention, a common-rail fuel-injection system is disclosed, wherein the fuel supply pump has plural plungers, each of which is operable correspondingly to the individual injection of the injector arranged in each cylinder.

In another aspect of the present invention, a common-rail fuel-injection system is disclosed, wherein the fuel supply pump is comprised of the plunger moving in and out inside a pump barrel, a cam mounted on a pump-drive shaft to push the plunger so as to deliver the fuel trapped in a pumping chamber that is defined by the plunger and the pump barrel, a fuel passage to lead the fuel into the pumping chamber, and an inlet valve to either open or block a fluid communication between the pumping chamber and the fuel passage, and wherein the control unit closes the inlet valve at preselected timing during a lift stroke of the plunger to regulate an amount of fuel to be returned to the fuel passage out of the fuel admitted in the pumping chamber, thereby governing the amount of fuel to be delivered under pressure out of the pumping chamber.

As the inlet valve opens at any preset timing during the delivery stroke of the plunger, the fuel admitted in the pumping chamber is allowed to partly return to the intake side for a duration till the inlet valve closes. Following the closure of the inlet valve, the fuel in the pumping chamber is forced towards the delivery side during the delivery stroke where the plunger is reaching top dead center on the delivery phase. Thus, the pre-stroke control is effected, which regulates an amount of fuel returned to the fuel passage out of the fuel admitted in the pumping chamber. As the inlet valve on pre-stroke control is temporarily regulated midway through its closure motion, the fuel is allowed to flow backwards to the fuel passage via the inlet valve that does not close completely but remains still opened partially. Accordingly, because it is avoidable to force towards the delivery side all the fuel equivalent to the volume in the reducing pumping chamber at the timing where the plunger starts to lift, a sudden rise of fuel pressure is relaxed, which might otherwise happen spontaneously with the beginning of fuel delivery. This contributes to suppressing the occurrence of vibration in the fuel supply pump and excess pressure in the common rail.

In a further another aspect of the present invention, a common-rail fuel-injection system is disclosed, wherein a pressure control chamber is provided by a valve body of the inlet valve and a valve cylinder in which the valve body moves in and out, while a control valve is arranged to either open or block a fluid communication between the pressure control chamber and the fuel passage, so that opening the control valve results in connecting the pressure control chamber with the fuel passage in a fluid communication to allow the inlet valve to move in and out, whereas closing the control valve results in blocking the fluid communication between the pressure control chamber and the fuel passage to keep the inlet valve against moving in and out. Actuation of the inlet valve may be controlled dependent on a back pressure introduced by the control valve. This makes it possible to render simple in construction the mechanism for opening and closing the inlet valve.

In accordance with the common-rail fuel-injection system of the present invention constructed as described above, the fuel delivered out of the fuel supply pump is stored under pressure in the common rail, while the control unit governs both of the fuel delivery out of the fuel supply pump into the common rail and the injectors where the fuel supplied from the common rail is injected into the combustion chambers, on the basis of the desired injection factors found dependent on the signals reported from the sensor means to monitor the engine operation conditions including the common-rail pressure.

In contrast, in the conventional common-rail fuel-injection systems, a plunger to deliver the fuel corresponds to a cylinder where the common-rail pressure restored with the fuel delivery out of the plunger will drop due to the next fuel injection out of the associated injector. Consequently, if the individual plungers varied in mechanical characteristics and aging thereof, the common-rail pressure would be much subject to changes in pressure rise and thus not always maintained in the desired common-rail pressure.

Nevertheless, in the common-rail fuel-injection system according to the present invention, the pressure sensor installed in the common rail detects the actual common-rail pressure at the time that has been restored with the fuel delivery out of the fuel supply pump but before the pressure drop due to the fuel injection. The control unit is reported with the pressure level in the common rail, which is recovered by the individual plunger strokes of the fuel supply pump, and thus enable to compensate the amount of fuel delivered at every plunger stroke thereby eliminating the deviation from the desired common-rail pressure. Thus, since there is no variation in the common-rail pressure restored, it becomes possible to make the amount of fuel injected uniform. Especially, even on low-speed operation of engines such as idling, there is no scattering in combustion condition at every cylinder, which might otherwise raises the variations in combustion condition, resulting in the occurrence of uncomfortable vibration or noise.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DESCRIPTION OF THE PREFERRED EMBODIMENTS

Preferred embodiments of a common-rail fuel-injection system according to the present invention will be explained in detail hereinafter with reference to the accompanying drawings.

Figure 1:
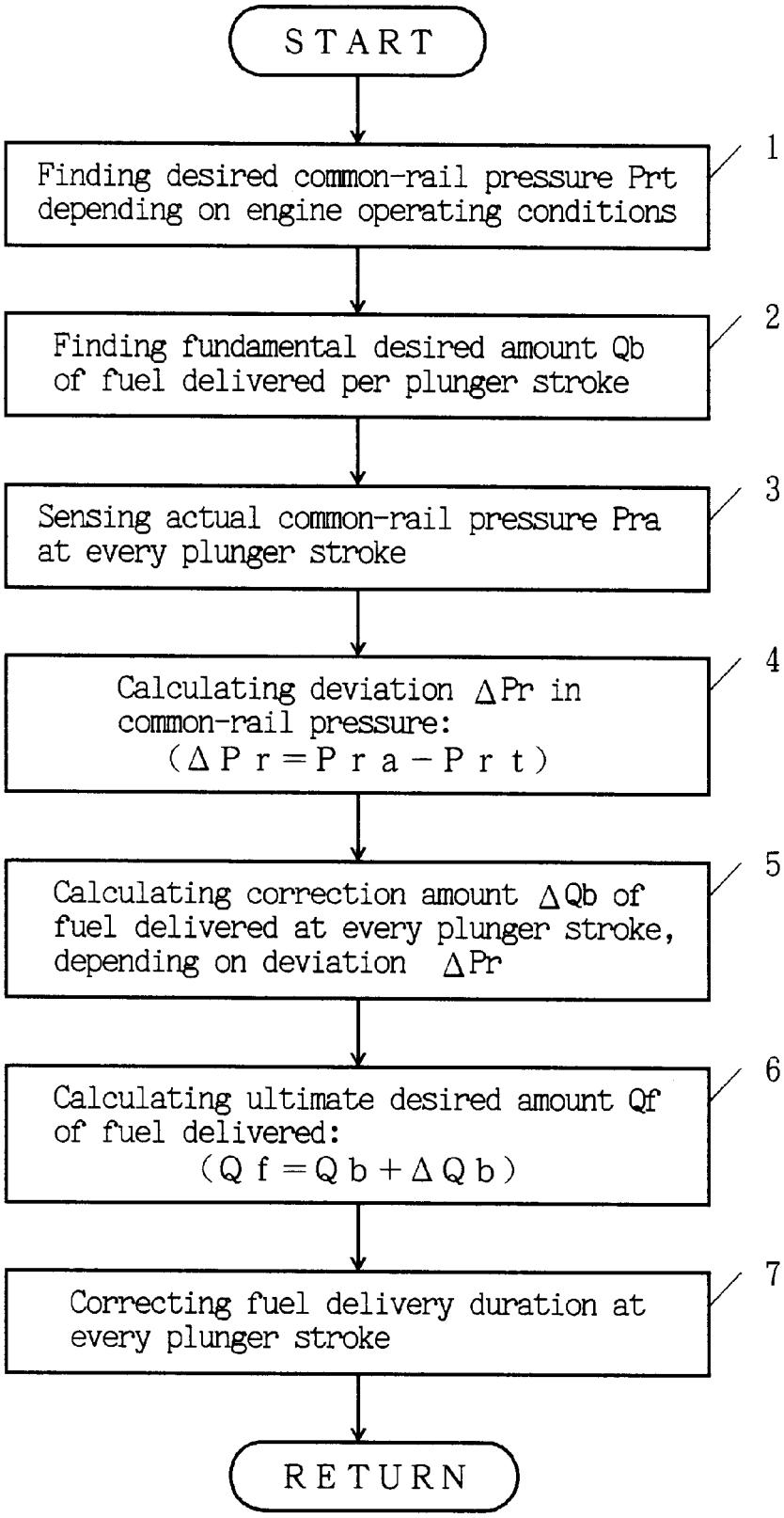
FIG. 1 is a flowchart explaining a fuel-injection control of a common-rail fuel-injection system in accordance with the present invention.
Figure 2:
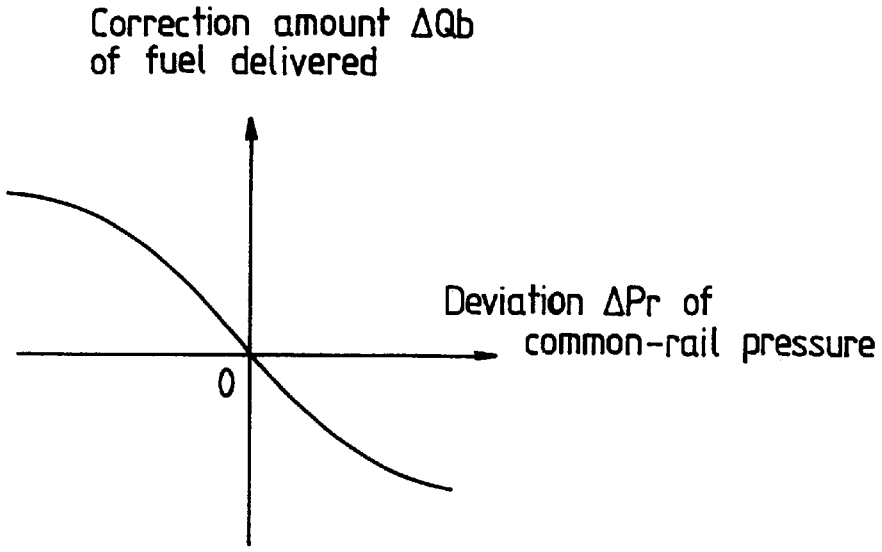
FIG. 2 is a graphic representation showing the relationship between deviation in common-rail pressure and correction amount of fuel delivered in the fuel-injection system shown in FIG. 1.
Figure 3:
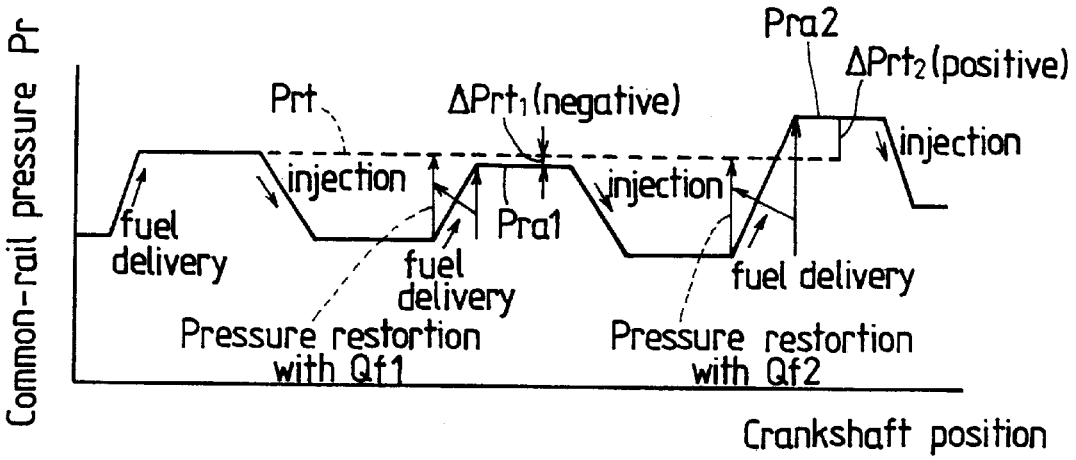
FIG. 3 is a graphic representation explaining changes in a common-rail pressure in terms of the elapse of crankshaft position.

First referring to FIGS. 1 to 3, there is shown a control process of an amount of fuel delivered out of a high-pressure fuel-supply plunger pump in the common-rail fuel-injection system. The high-pressure fuel-supply plunger pump 1 in the embodiment illustrated is of the type in which plural plungers are in turn actuated.

Finding a desired value of common-rail pressure, or a desired common-rail pressure Prt in accordance with engine operating conditions such as an engine rpm Ne, accelerator pedal depression Ac and the like, which are reported from their associated sensors (Step 1). The desired common-rail pressure Prt, as having been described above, is determined according to a fuel-injection duration to realize a desired amount of fuel to be injected, which is defined on the basis of data mapped previously in memory depending on the engine operating conditions. More desired amount of fuel injected results in higher desired common-rail pressure. Finding a fundamental desired amount Qb of fuel delivered per plunger stroke to keep the desired common-rail pressure Prt (Step 2).

The fundamental desired amount Qb of fuel delivered is determined by considering the engine operating conditions and recent common-rail pressure so as to maintain the desired common-rail pressure Frt. A pressure sensor 22 installed in a common rail 2 monitors continually hydraulic pressure in the common rail 2 to sense an actual common-rail pressure Pra, which is restored with a fuel delivery from the high-pressure fuel-supply plunger pump 1 and just before a pressure drop resulting from a fuel injection out of any associated injector 3 (Step 3). The actual common-rail pressure Pra is sensed for every plunger in the high-pressure fuel-supply plunger pump 1, which is in fuel-delivery stroke.

Calculating a deviations ΔPr (=Pra−Prt) between the desired common-rail pressure Pra given at the step 1 and the actual common-rail pressure Prt obtained at the step 3 (Step 4). In order to find another fundamental desired amount of fuel to be delivered at next plunger stroke, a correction amount ΔQ of fuel delivered to compensate the fundamental desired amount Qb of fuel delivered is calculated for the next plunger stroke in accordance with the deviation ΔPr obtained at the step 4, on the basis of a function or a data mapped previously in memory as shown in FIG. 2 (Step 5). When the deviation ΔPr is in a positive sense, the actual common-rail pressure Pr is higher than the desired common-rail pressure Prt and, therefore, the correction amount ΔQ of fuel delivered becomes a negative sense. In contrast, a negative deviations Pr makes deviation ΔPr positive. As an alternative to the mapped data, the correction amount ΔQ of fuel delivered may be obtained by a function of a variable, deviation ΔPr. Compensating the fundamental desired amount Qb of fuel delivered with the correction amount ΔQ of fuel delivered to calculate an ultimate desired amount Qf of fuel delivered (Step 6). The associated plunger is controlled in a pre-stroke way in accordance with the ultimate desired amount Qf of fuel delivered, which has been found in the step 6, to correct the fuel delivery duration (Step 7).

Especially, when the correction amount ΔQb of fuel delivered is in a negative sense, a fuel inlet valve, which will be described in detail hereinafter, corresponding to the associated plunger is delayed in timing of closure to reduce the amount Qb of fuel delivered. In contrast, the positive correction amount ΔQb of fuel delivered results in advancing the closure timing, thereby increasing the amount Qb of fuel delivered. Even if the actual common-rail pressure restored by the operation of the plunger were a pressure Pral below the desired common-rail pressure Prt as shown in FIG. 3, the ultimate desired amount Qf1 of fuel delivered, which is compensated by any increment, would be applied to the common rail at next fuel delivery cycle of the associated plunger. Thus, it will be anticipated that the desired common-rail pressure Prt is restored regardless of the inherent scattering in the amount of fuel delivered per plunger stroke. If the actual common-rail pressure restored by the last operation of the plunger were a pressure Pra2 above the desired common-rail pressure Frt, as is the above case, the ultimate desired amount Qf2 of fuel delivered, which is compensated by any decrement, would be supplied to the common rail at recent fuel delivery cycle of the associated plunger. Thus, it will be expected that the common-rail pressure be kept at most the desired common-rail pressure Frt.

In accordance with the common-rail fuel-injection system of the present invention, the amount of fuel delivered may be compensated at every plunger stroke and, therefore, the common-rail pressure Pr is governed adequately to come in matching the desired common-rail pressure Prt. On seeking to ensure the desired amount of fuel to be injected out of the injector, which is found depending on the engine operating conditions, any conventional common-rail fuel-injection system has caused a variation in the common-rail pressure Pr and a corresponding change in fuel-injection duration, which resulted in the occurrence of the scattering in firing condition in every combustion chamber, thus raising the undesirable vibration and noise in the engine. Nevertheless, the control process according to the present invention lets continually the common-rail pressure Pr match the desired common-rail pressure Prt, thereby preventing the occurrence of the uncomfortable vibration and noise, which might otherwise take place due to the scattering in combustion.

Figure 4:
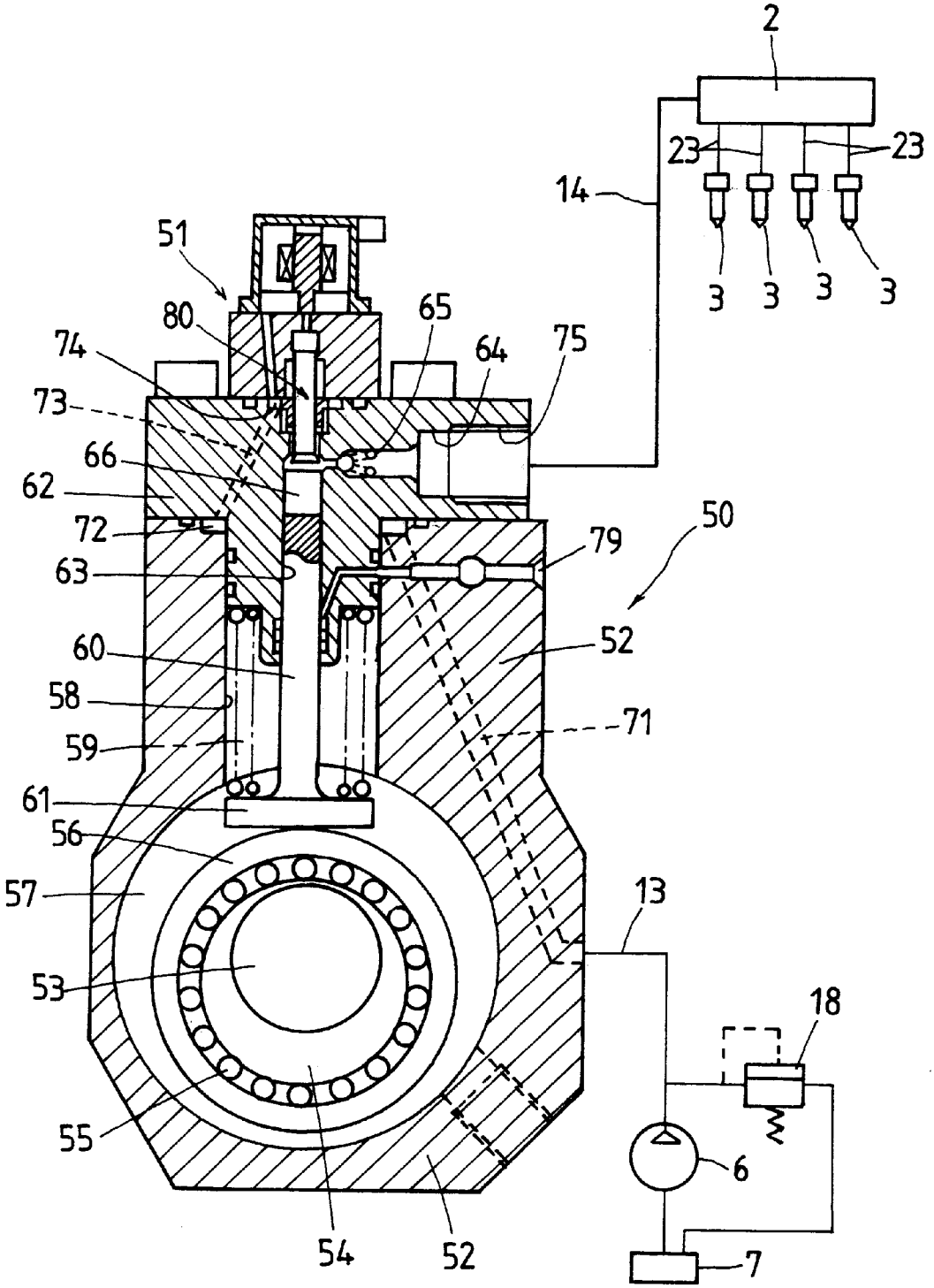
FIG. 4 is a schematic view, partly in section, showing a preferred embodiment of a fuel-supply plunger pump employed in the common-rail fuel-injection system according to the present invention.
Figure 5:
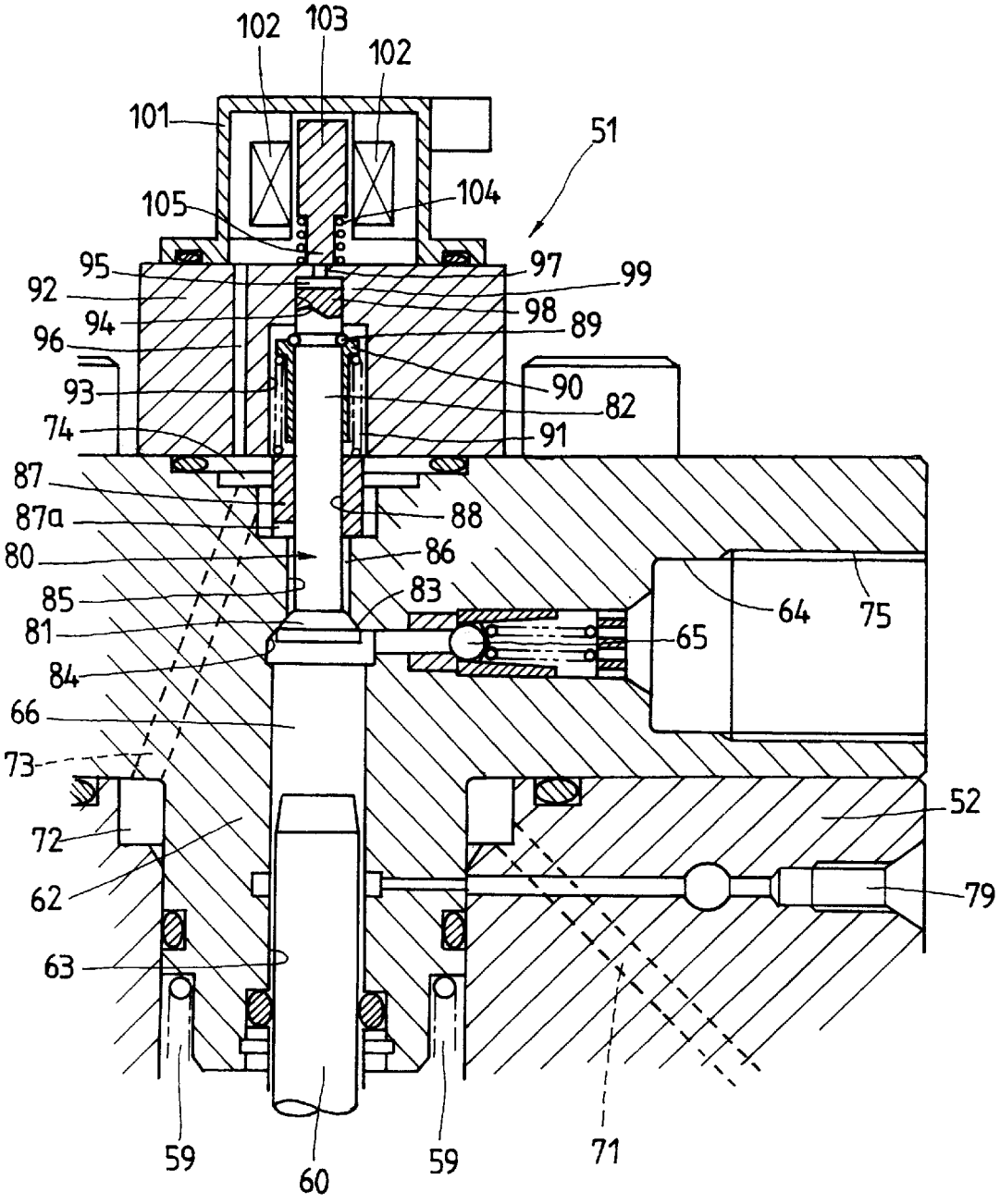
FIG. 5 is an enlarged fragmentary view in section showing the essential parts including therein an inlet valve of the fuel-supply plunger pump shown in FIG. 4.
Figure 6:
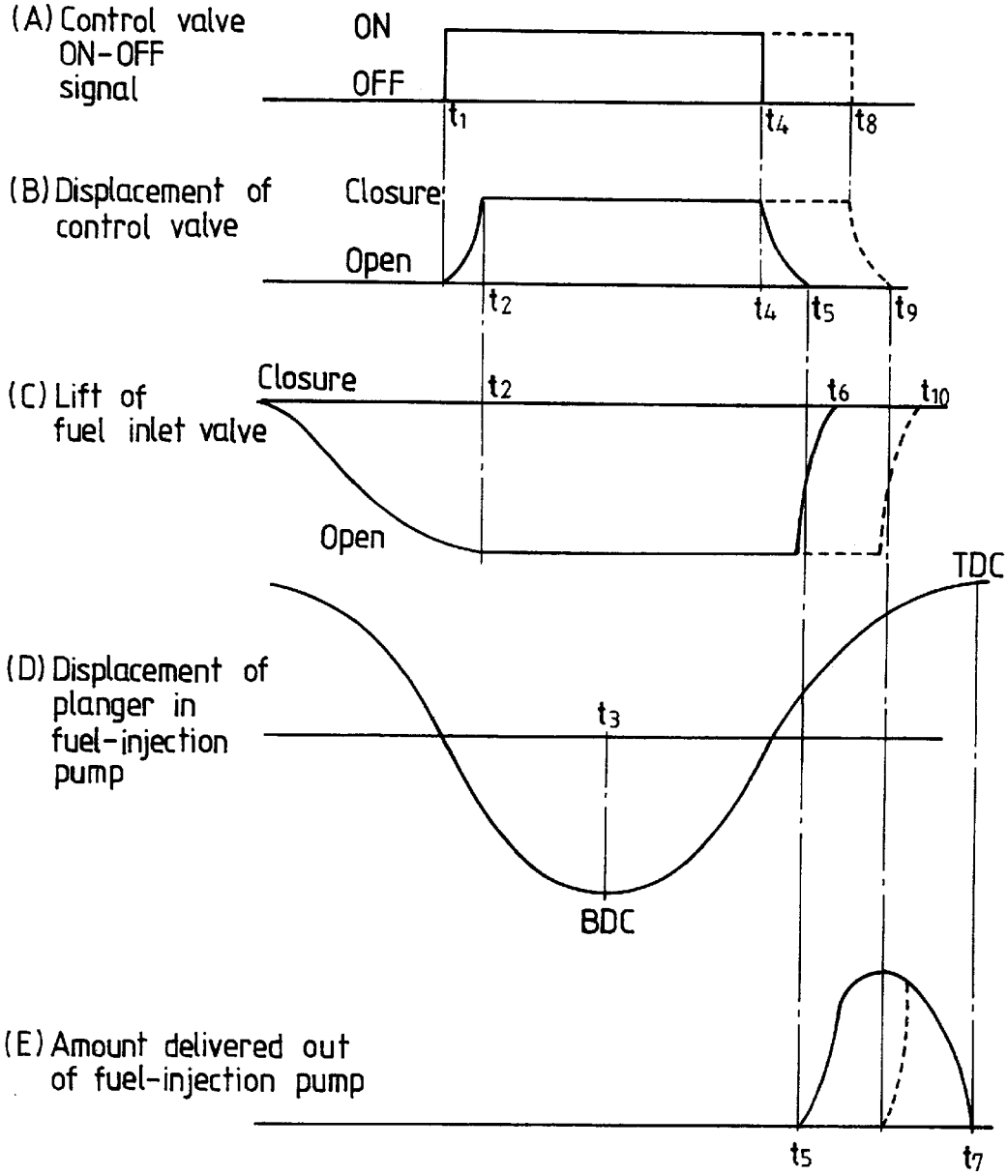
FIG. 6 is a composite chart showing a timing relation of several variables in the fuel-supply plunger pump shown in FIGS. 4 and 5.

Referring now to FIGS. 4 to 6 showing an example of the high-pressure fuel-supply plunger pump, pre-stroke control to alter the fuel delivery duration will be explained in detail hereinafter.

Figure 7:
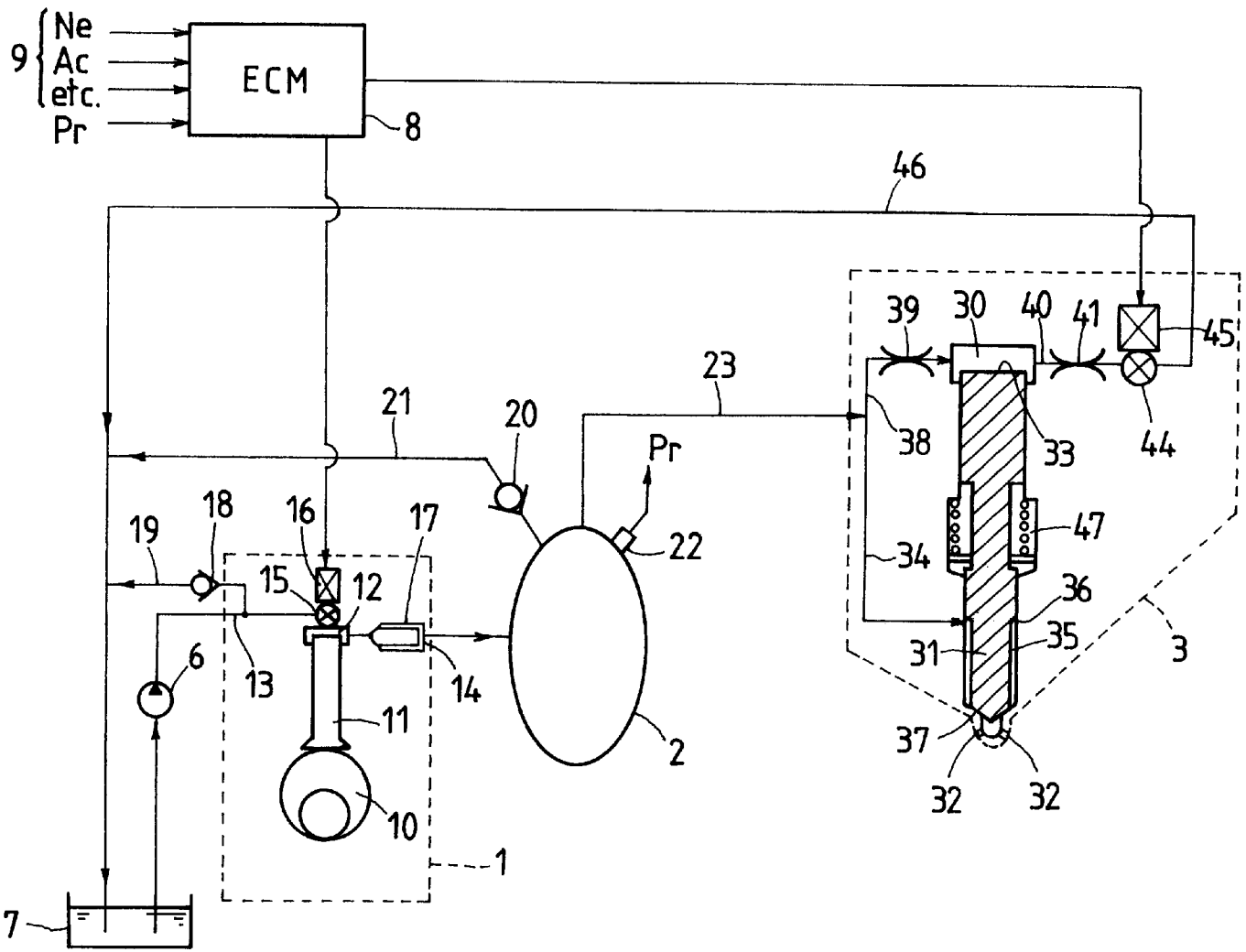
FIG. 7 (PRIOR ART)
FIG. 7 is a general schematic view, partly in section, illustrating a conventional common-rail fuel-injection system.

Except for the construction of the high-pressure fuel-supply plunger pump, the common-rail fuel-injection system having incorporated therein the high-pressure fuel-supply plunger pump is substantially identical in most components thereof, compared with the system shown in FIG. 7, so that the previous description will be applicable. The injector employable in the common-rail fuel-injection system of the present invention is also the same as previous described. The same reference characters are labeled on components equivalent in function with the components or members incorporated in the common-rail fuel-injection system shown in FIG. 7, other than the fuel-injection plunger pump, so that the previous description will be applicable.

FIG. 4 illustrates schematically the entire construction of a high-pressure fuel-supply plunger pump 50 to be employed in the common-rail fuel-injection system of the present invention. The high-pressure fuel-supply plunger pump 50 has a pump housing 52 where a camshaft 53 to drive the pump is supported for rotation. The camshaft 53 is driven from a crankshaft of an engine through suitable power transmissions such as belt drives. The camshaft 53 has thereon a pump-drive cam, which is comprised of an eccentric cam 54 mounted integrally on camshaft 53, and a rotary ring 56 fitted around the periphery of the eccentric cam 54 for rotation through bearings 55. The eccentric cam 54, bearings 55 and rotary ring 56 are all accommodated in a cam chamber 57 in the pump housing 52. A plunger 60 is arranged for linear reciprocating movement in a bore 58 opened to the cam chamber 57 in the pump housing 52, and urged against the rotary ring 56 by the elastic action of a plunger return spring 59. The plunger 60 terminates at its one end in tappet 61, which comes at its one surface in engagement with one end of the plunger return spring 59 while at the opposite surface in abutment with the rotary ring 56.

A pump barrel 62 is mounted on a top surface of the pump housing 52 to form together a pump body. The pump barrel 62 provided therein with a barrel bore 63 in which the plunger 60 fits for sliding movement. The pump barrel 62 is further made at an upper area thereof with a discharge port 64 extending sideways, where a delivery valve 65 of a check valve is arranged. The plunger 60 is accommodated for reciprocating movement in the barrel bore 63 of the pump barrel 62 in such a manner as to provide a pumping chamber 66, which is defined in the upper area of the barrel bore 63 on the top of the plunger 60.

Fuel delivered at a low pressure out of the fuel-feed pump 6 through a fuel-supply line 13 is charged into a fuel gallery 74, formed on the top surface of the pump housing 52, through a fuel passage 71 made in the pump housing 52, an annular channel 72 formed at an interface of the pump housing 52 with the pump barrel 62, and a fuel inlet passage 73 extending upwardly through the pump housing 52 from the annular channel 72. The fuel line 13 branches to a by-pass line in which the relief valve 18 is arranged so that a fuel pressure over a preselected pressure level may be returned to the fuel tank 7 via the relief valve 18. The fuel gallery 74 is communicated with the pumping chamber 66 through an inlet valve 80, as will be described in detail hereinafter.

The discharge port 64 is made with threads at 75, to which the fuel discharge line 14 is coupled to lead the delivered fuel to a common rail 2. The fuel is intensified in pressure in the pumping chamber 66 up to a high fuel-pressure, where the pressurized fuel forces the delivery valve 65 opening to thereby reach the common rail 2 through the fuel discharge line 14. The fuel leaking out through around the plunger 60 is recovered via a drain port 79, with being separated from lubricating oil.

The pump barrel 62 is provided with the inlet valve 80 to intermittently open and block a fluid communication between the pumping chamber 66 and the fuel gallery 74, and a control valve 51 to operate the inlet valve 80. Combination of the inlet valve 80 with the control valve 51 will be described below in conjunction with FIG. 5. The inlet valve 80 has a valve head 81 arranged in the pumping chamber 66, and a valve stem 82 extending out of the pump barrel 62 into the control valve 51. At closure event of the inlet valve 80, a valve face 83 of the valve head 81 comes in abutment with a valve seat 84 to block the pumping chamber 66 from the fuel gallery 74. The valve stem 82 extends through a hole 85 in the pump barrel 62, with keeping an annular clearance 86 around the valve stem 82. Moreover, the valve stem 82 slide-fits in a guide hole 88 of a cylindrical bushing 87 at an upper area of the hole 85.

A snap ring 89 is fitted around the upper portion of the valve stem 82 while a spring guide 90, also serving as a spring bearing, is fitted on the valve stem 82. Thus, the snap ring 89 comes in engagement with the spring guide 90 to be kept against linear motion relatively of the valve stem 82. A compression spring 91 acting on the inlet valve 80 is interposed between the bushing 87 and the spring guide 90 under compressed condition. Thus, the compression spring 91 urges forcibly the inlet valve 80 towards its closure position, where the valve head 81 come in fluid-tight contact with its valve seal 84. A valve cap 92 is mounted on the pump barrel 62 to shield fluid-tightly the fuel gallery 74 through a sealing ring. The valve cap 92 is made therein with a central recess 93, where the valve stem 82 is received at the upper portion thereof. The valve stem 82 fits snugly at its top end 98 in a bore 94 in the valve cap 92, following passing through the guide hole 88 in the bushing 87, whereby the valve stem 82 may be ensured against becoming off-centre or eccentric, which might be otherwise happen due to the hydraulic pressure acting on the inlet valve 80 when the plunger 60 lifts or moves in.

The valve cap 92 has at the center thereof a valve cylinder 99 made with the bore 94. The valve stem 82 of the inlet valve 80 fits for sliding movement at its head portion 98 in the valve cylinder 99 thereby providing, in combination with inside walls of the bore 94, a pressure-control chamber 95 above the head portion 98 of the valve stem 32. Moreover, the valve cap 92 is made with a path 96 that is opened at one end thereof to the fuel gallery 74. The path 96 may be connected selectively with the pressure-control chamber 95 through a small passage 97 formed in a ceiling wall of the bore 94, so that the fuel pressure of low-pressure fuel applied from the fuel supply pump 6 is allowed to reach the pressure-control chamber 95. The control valve 51 mounted fluid-tightly on the top face of the valve cap 92 is to provide a fluid communication between the path 96 and the small passage 97 and at the same time to open and close intermittently an open end of the small passage 97. A fuel circuit in the high-pressure fuel-supply plunger pump 50 to lead the fuel into the pumping chamber 66 is composed of the fuel passage 71 extending through both the pump housing 52 and the pump barrel 62, the annular channel 72, the fuel inlet passage 73 and the path 96 made in the valve cap 92.

The control valve 51 has a valve housing 101 attached fluid-tightly to the top face of the valve cap 92 through a sealing ring. The control valve 51 is a solenoid-actuated valve accommodated in the valve housing 101 and mainly composed of a solenoid 102 energized with signals issued from a control unit, an armature 103 actuated in accordance with energization/deenergization of the solenoid 102, and a return spring 104 biasing the armature 53. The armature 103 terminates at its distal end in a valvular portion 105 acting as a two-way valve, which opens or closes the open end of the small passage 97 thereby making the pressure-control chamber 95 communicate with or isolate fluid-tightly from the low-pressure side. Upon energizing the solenoid 102, the armature 103 is forced to move downwards against the resilient force of the return spring 104 and, thus, the valvular portion 105 blocks the open end of the small passage 97, with resulting in keeping the pressure-control chamber 105 at a fluid-tightly isolated condition. In contract, when the solenoid 102 is deenergized, the armature 103 lifts by the action of the return spring 104 to open the small passage 97, through which the pressure-control chamber 105 is allowed to communicate with the low-pressure side.

Operation of the embodied high-pressure fuel-supply plunger pump will be explained below in conjunction with FIG. 6 showing a composite chart of a timing relation of several variables. FIG. 6(A) shows the "on-off" operation of a signal to actuate the control valve. FIG. 6(B) is a graphic representation of the displacement of the control valve when operated in accordance with the signal in FIG. 6(A). FIG. 6(C) explains the lift of the inlet valve when the control valve is operated as shown in FIG. 6(B), while FIG. 6(D) is a curve showing the displacement of the plunger in the high-pressure fuel-supply plunger pump. Finally, FIG. 6(E) is a graphic representation showing the amount of fuel delivered out of the high-pressure fuel-supply plunger pump.

The low-pressure fuel forced by the fuel-feed pump 6 flows through the fuel passage 71, annular channel 72 and fuel inlet passage 73, and then fed into the fuel gallery 74. As will be seen from FIGS. 6(A) to (E), when the control valve 51 is kept on "turn-off", the armature 103 is urged by the action of the return spring 104 to its home position, where the valvular portion 105 opens the small passage 97 to help ensure the fluid connection through which the pressure-control chamber 95 is allowed to communicate with the low-pressure side. Thus, the pressure-control chamber 105 permits ingress and egress of the low-pressure fuel. As the plunger 60 moves downwards, the pumping chamber 66 is reduced in pressure. As a result, the inlet valve 80 is made open against the resilient force of the compression spring 91, depending on the force balance of the hydraulic pressures exerted on the inlet valve 80. Thus, the fuel in the fuel gallery 74 is admitted into the pumping chamber 66 through over the valve face 83 of the valve head 81, which has been moved off the valve seal 84, after flowing through a slot 87*a* at the bottom of the bushing 87 and the annular clearance 86 provided around the valve stem 82 inside the hole 85. That is to say, the inlet valve 30 moves to the direction where the valve face 83 moves off the valve seat 84 to permit the fuel to flow into the pumping chamber 66.

The instant $t_1$ the plunger 60 starts to move towards minus direction away from its reference point or neutral position, the actuating signal is turned on to energize the control valve 51. Thus, the control valve 51 begins at the timing $t_1$ to shift towards the closure and then continues the displacement until the timing $t_2$ the valvular portion 105 blocks completely the small passage 97 to isolate the pressure control chamber 95. Therefore, the inlet valve 80 ceases to lift towards its opening at the timing $t_2$ when the inlet valve 80 is at its full-lift event. In this way, the fuel continue to enter the pumping chamber 66 through the still-lifted or still-opened inlet valve 80 for a length of time till the timing $t_3$ the plunger 60 reaches bottom dead center (BDC).

After the instant $t_3$ the plunger 60 has reached bottom dead center (BDC), the fuel in the pumping chamber 66 is expelled as the plunger 60 moves from the bottom to the top of its stroke. With this event, the fuel in the pressure-control chamber 95 is kept from escaping out and, therefore, the inlet valve 80 is not allowed to close, but remains open. The passage 97 is made very small in its cross section. This enables a small or miniature solenoid to satisfactorily resist the fuel pressure in the pressure control chamber 95. Thus, the fuel in the pressure control chamber 95, even if boosted up to a considerably high pressure, never thrusts upwards the armature 102 against the motive force of the solenoid 102. As a result, the pressurized fuel in the pumping chamber 66 cannot be tolerated to open a delivery valve 65 leading to the fuel discharge line 14, but may flow backwards to the low-pressure side such as the fuel inlet passage 13, fuel gallery 74 and the like via the still-opened inlet valve 80. The relief valve 18 works to return the fuel tank 7 the amount of fuel equivalent with the fuel that has flowed backwards to the low-pressure side such as the fuel inlet passage 13.

When the actuating signal applied to the control valve 51 is turned off at any instant $t_4$ during the plunger 60 is moving from the bottom (BDC) to the top (TDC) of its stroke, the armature 103 of the control valve 51 is relieved to move upwards under the influence of the resilient force of the return spring 104. This causes the valvular portion 105 to start opening the small passage 97. In consequence, the control valve 51 opens completely the pressure-control chamber 95 at the time $t_5$. On this event, since the pressure-control chamber 95 comes in fluid communication with the low-pressure side thereby lowering in pressure, the inlet valve 80 moves upwards to begin closing under the pressure of fuel that has been intensified in pressure in the pumping chamber 66. The inlet valve 80 is completely closed at the timing $t_6$. Following the beginning of the closure of the inlet valve 80, thus, the fuel in the pumping chamber 66 starts to cease from flowing backwards to the low-pressure side, and the resultant pressurized fuel in the pumping chamber 66 is delivered beginning to the fuel delivery line 14 through the delivery valve 65. The pressurized fuel in the pumping chamber 66 continues delivered to the fuel delivery line 14 till the instant $t_7$ the plunger 60 reaches top dead center (TDC) of its stroke.

Dotted curves in FIGS. 6(A) to (E) represent changes that might occur on the associated variables when having delayed the timing to switch the control valve 51 from "on" to "off". That is to say, when the timing the control valve 51 is turned off is delayed till the time $t_8$, the armature 103 of the control valve 51 is also retarded in its displacement. Thus, the timing the control valve 51 is opened beginning and the timing the inlet valve 80 is closed beginning are both made delayed respectively, till the time $t_9$ and the time $t_{10}$. This inevitably causes a delay to the timing the pressurized fuel in the pumping chamber 66 opens the delivery valve 65 to start delivered to the fuel delivery line 14, resulting in reducing the amount of fuel delivered out of the pumping chamber 66 until the time $t_7$ the plunger 60 reaches top dead center (TDC) thereof. In contrast, even if the timing the control valve 51 is turned off is advanced, the closure of the control valve 51 is also advanced. Thus, the amount of fuel delivered out of the pumping chamber 66 may be increased. In this way, shifting the timing to switch the control valve 51 from "on" to "off" may resulting in controlling the amount of fuel delivered out of the pumping chamber 66.

As this invention may be embodied in several forms without departing from the spirit of essential characteristics thereof, the present embodiment is therefore illustrative and not restrictive, since the scope of the invention is defined by the appended claims rather than by the description proceeding them, and all changes that fall within meets and bounds of the claims, or equivalence of such meets and bounds are therefore intended to embraced by the claims.

What is claimed is:

1. A common-rail fuel-injection system for an internal combustion engine; comprising a fuel supply pump to deliver fuel with pumping action of a plunger, a common rail to store therein the fuel delivered out of the fuel supply pump under pressure, injectors each of which is arranged in each cylinder of the engine, to inject the fuel in the common rail into the cylinders, sensor means to monitor engine operating conditions, a pressure sensor to monitor a pressure in the common rail, and a control unit to find injection factors, including a desired common-rail pressure, of fuel to be injected out of the injectors, depending on signals reported from the sensor means, and further control a fuel delivery forced by the plunger in the fuel supply pump and a fuel injection out of the injector in accordance with the injection factors;

wherein the pressure sensor detects an actual common-rail pressure at the time between pressure restoration with the fuel delivered by the plunger and pressure drop due to fuel injection out of the injector, and the control unit compensates an amount of fuel to be delivered into the common rail, depending on a deviation of the actual common-rail pressure from the desired common-rail pressure, at every fuel delivery forced by the plunger, so that the actual common-rail pressure coincides with the desired common-rail pressure.

2. A common-rail fuel-injection system constructed as defined in claim 1, wherein the control unit finds a fundamental desired amount of fuel to be delivered by the plunger in accordance with the desired common-rail pressure, compensates the fundamental desired amount of fuel to be delivered with a correction amount of fuel which is calculated dependent on the deviation of the actual common-rail pressure, thereby finding an ultimate desired amount of fuel delivered at every fuel delivery forced by the plunger, and regulates a fuel delivery duration to be delivered by the plunger in accordance with the ultimate desired amount of fuel to make the actual common-rail pressure coincide with the desired common-rail pressure.

3. A common-rail fuel-injection system constructed as defined in claim 1, wherein the fuel supply pump has plural plungers, each of which is operable correspondingly to the individual injection of the injector arranged in each cylinder.

4. A common-rail fuel-injection system constructed as defined in claim 1, wherein the fuel supply pump is comprised of the plunger moving in and out inside a pump barrel, a cam mounted on a pump-drive shaft to push the plunger so as to deliver the fuel trapped in a pumping chamber that is defined by the plunger and the pump barrel, a fuel passage to lead the fuel into the pumping chamber, and an inlet valve to either open or block a fluid communication between the pumping chamber and the fuel passage, and wherein the control unit closes the inlet valve at preselected timing during a lift stroke of the plunger to regulate an amount of fuel to be returned to the fuel passage out of the fuel admitted in the pumping chamber, thereby governing the amount of fuel to be delivered under pressure out of the pumping chamber.

5. A common-rail fuel-injection system constructed as defined in claim 4, wherein a pressure-control chamber is provided by a valve body of the inlet valve and a valve cylinder in which the valve body moves in and out, while a control valve is arranged to either open or block a fluid communication between the pressure control chamber and the fuel passage, so that opening the control valve results in connecting the pressure control chamber with the fuel passage in a fluid communication to allow the inlet valve to move in and out, whereas closing the control valve results in blocking the fluid communication between the pressure control chamber and the fuel passage to keep the inlet valve against moving in and out.

* * * * *